US010857447B2

(12) United States Patent
Rainwater

(10) Patent No.: US 10,857,447 B2
(45) Date of Patent: Dec. 8, 2020

(54) POOL TABLE CUE AND BALL HOLDER

(71) Applicant: Mary Louise Rainwater, Lancaster, CA (US)

(72) Inventor: Mary Louise Rainwater, Lancaster, CA (US)

( * ) Notice: Subject to any disclaimer, the term of this patent is extended or adjusted under 35 U.S.C. 154(b) by 0 days.

(21) Appl. No.: 13/999,472

(22) Filed: Feb. 28, 2014

(65) Prior Publication Data

US 2016/0023090 A1 Jan. 28, 2016

(51) Int. Cl.
*A47F 7/00* (2006.01)
*A63D 15/00* (2006.01)
*A63D 15/10* (2006.01)

(52) U.S. Cl.
CPC ..... *A63D 15/10* (2013.01)

(58) Field of Classification Search
CPC ..... A63D 15/00; A63D 15/10; A63D 15/08; A63D 15/105; A47F 7/0028; A47B 81/005
USPC ..... 211/68, 14
See application file for complete search history.

(56) References Cited

U.S. PATENT DOCUMENTS 479,213 A * 7/1892 Fuchs ..... 211/15
1,127,318 A * 2/1915 Thomas ..... 473/1
2,221,704 A * 11/1940 Farley ..... 312/49
2,489,464 A * 11/1949 Roland ..... A63D 15/16 473/38
4,002,241 A * 1/1977 Parrilla, Sr. ..... 211/88.01
4,029,313 A * 6/1977 Angulo ..... 473/1
D251,764 S * 5/1979 Stahel ..... D11/147
D308,610 S * 6/1990 Ianni ..... D28/73
5,071,048 A * 12/1991 Price et al. ..... 224/604
D367,408 S * 2/1996 Fordyce ..... D19/77
5,690,235 A * 11/1997 Matzen ..... A63B 71/0045 211/60.1
5,984,112 A * 11/1999 Adams ..... A47F 7/0028 211/14
D422,439 S * 4/2000 Chen ..... D6/552
6,168,030 B1 * 1/2001 Morris ..... 211/13.1
6,419,588 B1 * 7/2002 Watlack ..... A63D 15/105 473/1
6,505,747 B1 * 1/2003 Robertson ..... A47F 7/283 211/194
6,537,156 B1 * 3/2003 Stagg ..... 473/40
6,629,897 B2 * 10/2003 Belknap ..... 473/40
6,742,982 B2 * 6/2004 Kelly ..... A63B 47/00 414/791.5
6,899,224 B2 * 5/2005 Sheffield ..... A63B 47/00 206/315.9
6,926,152 B2 * 8/2005 Leung ..... 206/769
6,945,413 B1 * 9/2005 Meyer ..... 211/68
D700,478 S * 3/2014 Simmons ..... D7/553.8
D728,694 S * 5/2015 Nelson et al. ..... D21/453
(Continued)

*Primary Examiner* — Kimberley S Wright
(74) *Attorney, Agent, or Firm* — Mannigf & Kass, Ellrod, Ramirez, Trester LLP; Roland J. Tong

(57) ABSTRACT

A holder that supports four cue sticks and a pool ball, preferably a cue ball. Holder contains four holes for insert of the tips of each cue stick and supports ball on top of holder. Shooting end of each cue stick is mounted in each corner pocket of pool table giving a teepee effect. A hook located inside center of holder is included to display placards or novelty items to add to the enhanced appearance of the pool table when not in use and for display. A small LED light is optional and located inside center of holder to accent displays from hook.

4 Claims, 3 Drawing Sheets

(56) References Cited

U.S. PATENT DOCUMENTS

| | | | | |
|---|---|---|---|---|
| D810,198 | S * | 2/2018 | Azar | D19/90 |
| 2002/0185388 | A1* | 12/2002 | Su | 206/217 |
| 2003/0183543 | A1* | 10/2003 | Sheffield | A63B 47/00<br>206/315.9 |
| 2003/0234230 | A1* | 12/2003 | Wang | 211/70.6 |
| 2004/0132535 | A1* | 7/2004 | Sumko | 473/2 |
| 2006/0009300 | A1* | 1/2006 | Hernandez | 473/42 |
| 2006/0144806 | A1* | 7/2006 | Joannou, Jr. | 211/85.7 |
| 2007/0039911 | A1* | 2/2007 | Sator | 211/68 |
| 2009/0308822 | A1* | 12/2009 | Byers | A47B 81/005<br>211/85.7 |
| 2012/0091019 | A1* | 4/2012 | Lin | 206/315.1 |

* cited by examiner

POOL TABLE CUE AND BALL HOLDER

CROSS REFERENCE TO RELATED APPLICATION

This application claims the benefit of U.S. Provisional Patent Application Ser. No. 61/851,099 Filed Feb. 28, 2013.

BACKGROUND OF THE INVENTION

1. Field of the Invention

The present invention relates to the field of pool tables, and more particularly, to a novel way to display a pool table by using the four pool cue sticks and a pool ball, preferably a cue ball, when not in use.

2. Description of the Related Art

It is estimated that there are approximately between 1.75 and 3 million home pool tables in the United States alone. This estimation is due to the quantity of pool tables sold in the United States every year, estimated at 200,000. This may not include the tables located in establishments such as, bars or taverns.

When not in use, normally a cover is placed on the table to protect it until played. Although impressive as it is, it is still a table with a cover. The cue stick and ball holder creates the pool table in to more than just a table; it becomes, what has been considered, a work of art and becomes the center of attention in the room. It creates a unique and very impressive way to turn a table into the center of attraction. With the teepee effect and utilization of display from the center of the holder, it quickly becomes a unique and impressive way to create a pool table into much more.

SUMMARY OF THE INVENTION

The pool cue stick and ball holder of the present invention, includes four pool cue sticks and a pool ball, preferably a cue ball. The tip of each of the four cue sticks are inserted into each hole in the holder and the shooters end of the pool cue stick is mounted into each corner pocket of the pool table. The pool ball, preferably a cue ball, rests in the top of the holder. A hook is screwed into the hole in the center of the holder on the inside and an optional LED light is located on the inside of the holder to accent the item displayed from the hook.

Accordingly, the pool cue stick and ball holder creates a way to turn a pool table into more than just a table while not in use. It creates a work of art into a pool table and soon becomes a conversation piece and center of attention.

BRIEF DESCRIPTION OF THE DRAWINGS

The features of the present invention, which are believed to be novel, are set forth particularly in the appended claim. The present invention, both as to its organization and manner of operation, together with further objects and advantages thereof, may be understood with reference to the following description, taken in connection with the accompanying drawings, in which:

DETAILED DESCRIPTION OF THE PREFERRED EMBODIMENTS

Figure 1:
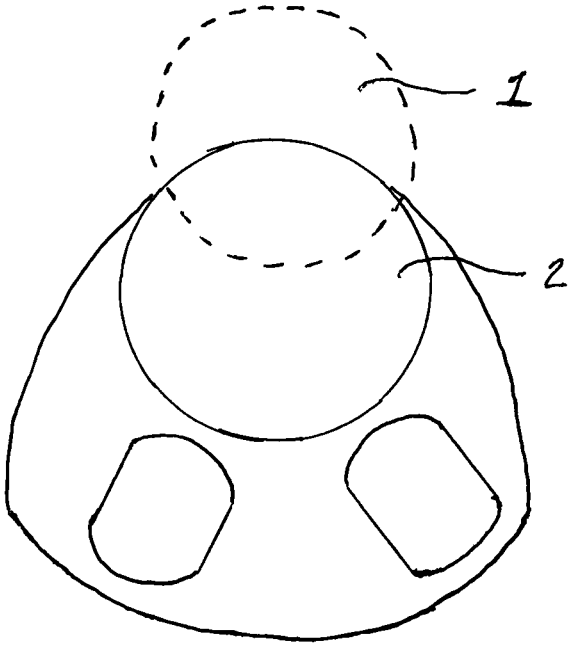
FIG. 1 is a top elevation view of the pool table cue stick and ball holder according to the present invention.

Referring to FIG. 1, the novelty cue stick and ball holder of the present invention is illustrated in an enlarged view. The pool ball, preferably a cue ball, identified by numeral 1, rests on top of the concave hole, identified by numeral 2, engineered to fit a pool ball. The solid inside hole supports the six divisions referenced in FIG. 3.

Figure 2:
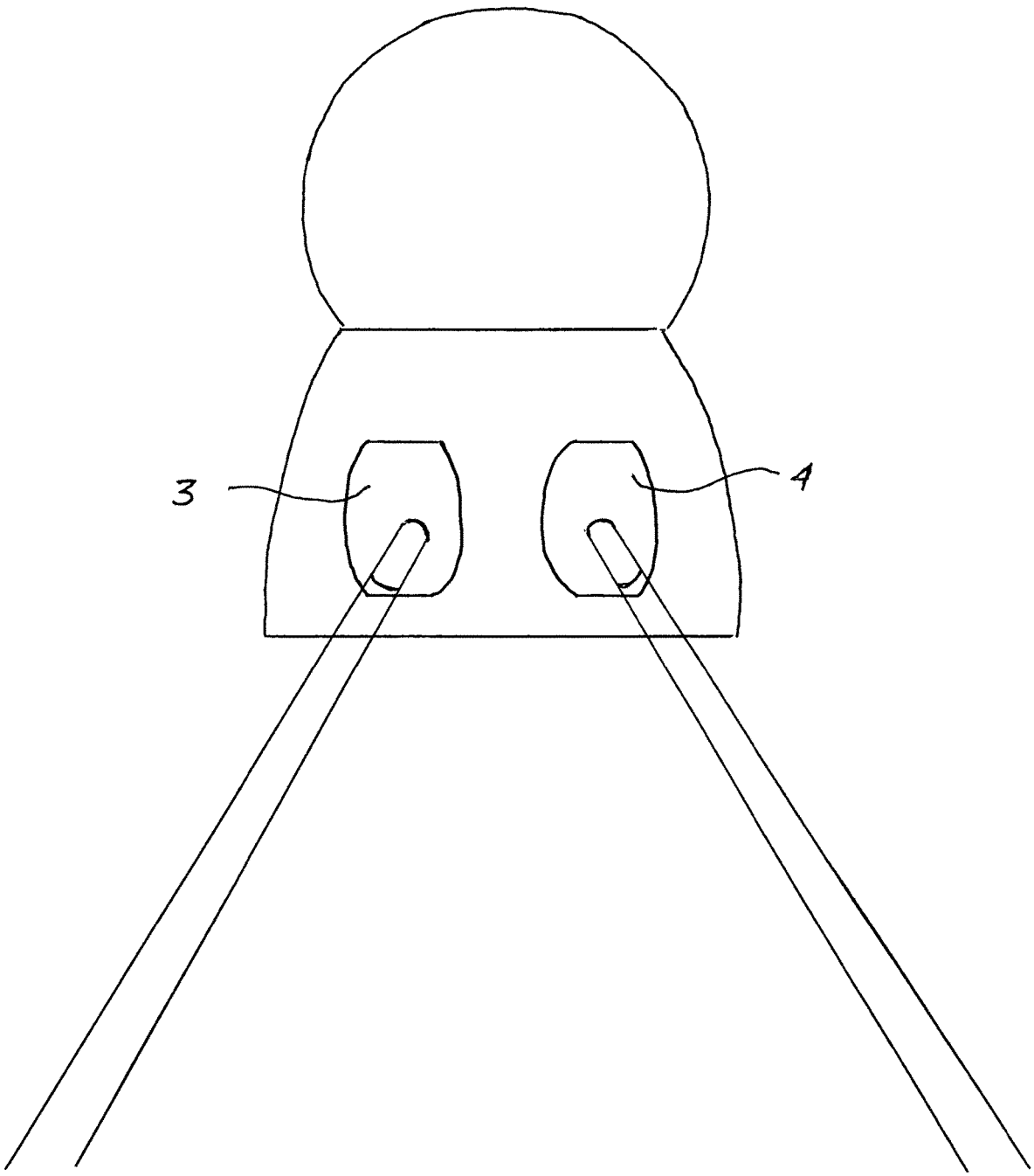
FIG. 2 is an enlarged side view of the holder according to the present invention.

Referring now in detail to FIG. 2, the pool table cue stick and ball holder is displayed in an enlarged side view. The holes in the holder, identified by numerals 3 and 4, are engineered to accommodate pool cue sticks for all sizes of pool tables. Side view mimics back side of view where other two holes are located.

Figure 3:
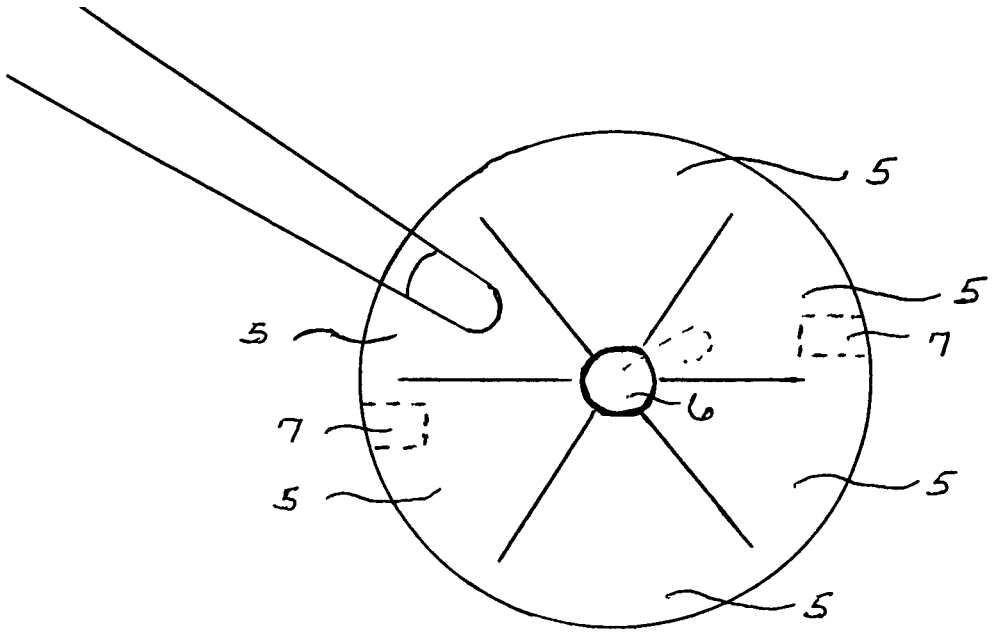
FIG. 3 is an inside view of the pool table cue stick and ball holder according to the present invention.

Referring now in detail to FIG. 3, the inside has six divisions, identified by numeral 5, are engineered to allow the pool cue sticks to adjust to the accommodation of all sizes of pool tables and provide the support of each cue stick. The center of the holder, identified by numeral 6, displays a hole where a hook is screwed in to provide the display of novelty items. An optional LED light, identified by numeral 7, is placed on inside of holder to accent novelty items. Since LED light is optional, drawing displays an example of where light would be located inside holder and is not indicative of actual size or exact placement.

The invention claimed is:

1. An apparatus for displaying and supporting a set of four pool cues on a pool table having a center and four corners, each pool cue having a proximal end having first diameter and a distal end having a second diameter smaller than the first diameter, the apparatus comprising:

- a housing having the shape of a truncated dome, the housing including
  - a top wall including an exterior side having a center, and an interior side having a center, and
  - a curved side wall including an exterior side, an interior side, and a circular bottom edge;
- a circular indentation formed in the center of the exterior side of the top wall of the housing, and configured to receive and support a pool ball;
- a set of six radially extending circumferentially spaced-apart partitions, each partition extending at an oblique angle to an adjacent partition and defining a side of a pie-shaped chamber having a narrow apex with a width less than the second diameter;
- a set of four circumferentially spaced-apart openings extending through the exterior and interior sides of the curved side wall, each opening being located midway between adjacent partitions and having a width and height greater than the second diameter;
- wherein the dimensions, position, and shape of the openings and partitions are selected such that when the proximal end of each pool cue is positioned in a different corner of the pool table and the corresponding distal end of each pool cue is inserted through a different one of the one of the four openings in the housing, the distal end of that pool cue will be retained between the sides of one of the pie-shaped chambers having a narrow apex and the housing will be supported directly over the center of the pool table.

2. The apparatus according to claim 1, further comprising a hook depending from the center of the interior side of the housing.

3. The apparatus according to claim 1, further comprising a light source mounted in the interior of the side wall of the housing.

4. The apparatus according to claim 1, wherein the dimensions of each opening are sufficient to allow the opening to receive and retain the distal end of one of the pool cues when the apparatus is positioned over the center of the table and the proximal end of the pool cue is positioned in a corner of the pool table, for various standard sizes of pool tables.

* * * * *